US008960315B2

(12) United States Patent
Nutley et al.

(10) Patent No.: US 8,960,315 B2
(45) **Date of Patent: *Feb. 24, 2015**

(54) SWELLABLE DOWNHOLE APPARATUS AND SUPPORT ASSEMBLY

(71) Applicant: Swelltec Limited, Aberdeen (GB)

(72) Inventors: Kim Nutley, Aberdeenshire (GB); Brian Nutley, Aberdeen (GB)

(73) Assignee: Swelltec Limited, Dyce, Aberdeen (GB)

( * ) Notice: Subject to any disclaimer, the term of this patent is extended or adjusted under 35 U.S.C. 154(b) by 0 days.

This patent is subject to a terminal disclaimer.

(21) Appl. No.: 13/924,101

(22) Filed: Jun. 21, 2013

(65) Prior Publication Data

US 2013/0277069 A1 Oct. 24, 2013

Related U.S. Application Data

(63) Continuation of application No. 12/768,882, filed on Apr. 28, 2010, now Pat. No. 8,561,689.

(51) Int. Cl.
*E21B 33/12* (2006.01)

(52) U.S. Cl.
CPC ..... *E21B 33/1208* (2013.01); *E21B 33/1216* (2013.01)
USPC ..... 166/387; 166/179; 166/187

(58) Field of Classification Search
CPC .. E21B 33/1216; E21B 33/1208; E21B 33/12
USPC ..... 166/179, 187, 185, 387, 202, 121, 134, 166/138
See application file for complete search history.

(56) References Cited

U.S. PATENT DOCUMENTS

| | | | | |
|---|---|---|---|---|
| 4,403,660 | A * | 9/1983 | Coone | 166/387 |
| 7,938,176 | B2 | 5/2011 | Patel | |
| 2007/0151724 | A1 * | 7/2007 | Ohmer et al. | 166/187 |

* cited by examiner

*Primary Examiner* — Yong-Suk (Philip) Ro
(74) *Attorney, Agent, or Firm* — Wong, Cabello, Lutsch, Rutherford & Brucculeri LLP

(57) ABSTRACT

A downhole apparatus and support assembly has a radially expanding portion comprising a swellable elastomeric material selected to increase in volume on exposure to at least one predetermined fluid, and the support assembly is operable to be deployed from a first retracted position to a second expanded condition. The support assembly comprises an inner surface arranged to face the radially expanding portion, and at least a portion of the inner surface is concave. The support assembly may be configured to direct a force from the swellable material to boost or energize a seal created between the radially expanding portion and a surrounding surface in use.

36 Claims, 13 Drawing Sheets

SWELLABLE DOWNHOLE APPARATUS AND SUPPORT ASSEMBLY

CROSS-REFERENCE TO RELATED APPLICATIONS

This application is a continuation of U.S. patent application Ser. No. 12/768,882, filed Apr. 28, 2010, which claims priority to United Kingdom Patent Application No. GB0907556.5, filed on May 1, 2009, both of which are hereby incorporated by reference in their entirety.

FIELD OF THE INVENTION

The present invention relates to downhole apparatus for use in hydrocarbon wells, and more particularly to downhole apparatus for use with swellable materials, such as are used in the hydrocarbon exploration and production industries. The invention also relates to a downhole tool incorporating the apparatus, and a method of use. Embodiments of the invention relate to isolation and sealing applications which use swellable wellbore packers.

BACKGROUND

In the field of hydrocarbon exploration and production, various tools are used to provide fluid seals between two components in a wellbore. Annular barriers have been designed for preventing undesirable flow of wellbore fluids in the annulus between a wellbore tubular and the inner surface of a surrounding tubular or the borehole wall. In many cases, the annular barriers provide a fluid seal capable of holding a significant pressure differential across its length. In one application, a wellbore packer is formed on the outer surface of a completion string which is run into an outer casing in a first condition having a particular outer diameter. When the packer is in its desired downhole location, it is inflated or expanded into contact with the inner surface of the outer casing to create a seal in the annulus. Similar wellbore packers have been designed for use in openhole environments, to create a seal between a tubular and the surrounding wall of the wellbore.

Conventional packers are actuated by mechanical or hydraulic systems. A force or pressure is applied from surface to radially move a mechanical packer element into contact with the surrounding surface. In an inflatable packer, fluid is delivered from surface to inflate a chamber defined by a bladder around the tubular body.

More recently, wellbore packers have been developed which include a mantle of swellable material formed around the tubular. The swellable material is selected to increase in volume on exposure to at least one predetermined fluid, which may be a hydrocarbon fluid or an aqueous fluid or brine. The swellable packer may be run to a downhole location in its unexpanded state, where it is exposed to a wellbore fluid and caused to increase in volume. The design, dimensions, and swelling characteristics are selected such that the swellable packer element expands to create a fluid seal in the annulus to isolate one wellbore section from another. Swellable packers have several advantages over conventional packers, including passive actuation, simplicity of construction, and robustness in long term isolation applications.

In addition, swellable packers may be designed for compliant expansion of the swellable mantle into contact with a surrounding surface, such that the force imparted on the surface prevents damage to a rock formation or sandface, while still creating an annular barrier or seal. Swellable packers therefore lend themselves well to openhole completions in loose or weak formations.

The materials selected to form a swellable element in a swellable packer vary depending on the specific application. Swellable materials are elastomeric (i.e. they display mechanical and physical properties of an elastomer or natural rubber). Where the swellable mantle is designed to swell in hydrocarbons, it may comprise a material such as an ethylene propylene diene monomer (EPDM) rubber. Where the swellable mantle is required to swell in aqueous fluids or brines, the material may for example comprise an N-vinyl carboxylic acid amide-based crosslinked resin and a water swellable urethane in an ethylene propylene rubber matrix. Suitable materials for swellable packers are described in GB 2411918 or WO2005/012686. In addition, swellable elastomeric materials designed to increase in volume in both hydrocarbon fluids and aqueous fluids are described in the applicant's co-pending International patent publication numbers WO2008/155564 and WO2008/155565.

Applications of swellable tools are limited by a number of factors including their capacity for increasing in volume, their ability to create a seal, and their mechanical and physical properties when in their unexpanded and expanded states. A swellable packer may be exposed to high pressure differentials during use. The integrity of the annular seal created by a well packer is paramount, and a tendency of the swellable material to extrude, deform, or flow under forces created by the pressure differential results in a potential failure mode between the apparatus and the surrounding surface. In practice therefore, swellable tools and in particular swellable packers, will be designed to take account of the limitations of the material. For example, a swellable packer may be run with an outer diameter only slightly smaller than the inner diameter of the surrounding surface, in order to limit the percentage volume increase of the swellable material during expansion. In addition, swellable packers may be formed with packer elements of significant length, greater than those of equivalent mechanical or hydraulic isolation tools, in order to increase the pressure rating and/or reduce the chances of breaching the seal at high differential pressures.

International patent publication number WO 2006/121340 describes an expandable end ring for a swellable packer which is said to anchor the packer material to the tubular more effectively. However, the arrangement of WO 2006/121340 does not address the problems of extrusion of the swellable material in use.

The applicant's co-pending International patent publication number WO 2008/062186 describes a support structure suitable for use with a swellable packer, which is operable to be deployed from a first unexpanded condition to a second expanded condition by the swelling of the packer. By providing a support structure which substantially covers the end of the swellable mantle, extrusion of the swellable material is mitigated. This permits packers to be produced with a required pressure rating which are shorter in length than conventional swellable packers. Furthermore, packers can be formed with reduced outer diameter, as the mechanical strength of the elastomeric material is less critical. The packer can therefore be engineered to have a larger expansion factor while maintaining shear strength and differential pressure rating. The arrangement of WO 2008/062186 therefore allows a swellable packer to be used over a wider range of operating parameters. Although the arrangement of WO 2008/062186 is suitable for use in many wellbore applications, in certain conditions its effectiveness and/or practicality are limited.

It is one aim of an aspect of the invention to provide a support assembly for a swellable material in a downhole apparatus, which is improved with respect to previously proposed support assemblies.

Other aims and objects will become apparent from reading the following description.

SUMMARY OF THE INVENTION

According to a first aspect of the invention there is provided a downhole apparatus having a radially expanding portion comprising a swellable elastomeric material selected to increase in volume on exposure to at least one predetermined fluid and a support assembly operable to be deployed from a first retracted position to a second expanded condition in which it at least partially covers an end of the radially expanding portion; wherein the support assembly comprises an inner surface arranged to face the radially expanding portion, and at least a portion of the inner surface is concave.

Elastomeric in this context means having the physical or mechanical properties of a rubber, and elastomeric material includes synthetic polymer materials and natural rubbers.

According to a second aspect of the invention there is provided a support assembly for a downhole apparatus having a radially expanding portion, wherein the radially expanding portion comprises a swellable elastomeric material selected to increase in volume on exposure to at least one predetermined fluid, wherein the support assembly is operable to be deployed from a first retracted position to a second expanded condition in which it at least partially covers an end of a radially expanding portion of the apparatus; wherein the support assembly comprises an inner surface arranged to face the radially expanding portion, and at least a portion of the inner surface is concave.

By providing a support assembly with a partially or fully concave inner surface, the support assembly is improved with respect to prior art designs. A larger volume of swellable material can be accommodated beneath the support assembly per unit axial length of the support assembly. Thus the volume of swellable elastomeric material that can be accommodated between the support assembly and the body of the apparatus is increased with respect to the prior art, providing a more robust sealing element.

Efficiently maximising the volume of rubber may in some embodiments allow a reduced radial profile of the support assembly and downhole apparatus, i.e. a sufficient volume can be accommodated beneath a support assembly of reduced outer diameter. The concave shape also allows the support assembly to be formed over a shorter axial length of the tool, compared with support devices proposed in the prior art. This reduces the additional length of the apparatus, or alternatively allows the length of the main swellable part of the apparatus to be maintained. This is a particular advantage in certain applications, including fracturing (or "fracing") applications.

The concave surface may be in the form of a curved bowl and/or may have a parabolic shape. The inventors have appreciated that such a concave shape provides an efficient transfer of swelling forces—which have radial and longitudinal components—to the support assembly for deployment to the expanded condition. This allows the support assembly to be deployed more easily, and in some cases further, than support devices proposed in the prior art. Thus the deployment of the support assembly has a reduced impact on the normal swelling profile and swell time of the apparatus. In particular the inventors have appreciated that the concave shape provides an efficient harnessing of longitudinal forces—for example due to down weight, pulling force, or differential pressures—which are directed to further deploy of the support assembly. This improves the operation of the support assembly by increasing its anti-extrusion and immobilization capabilities, resulting in a more reliable annular seal.

Preferably the majority or substantially all of the inner surface is concave. In other words, the support assembly comprises a support component which has an inner surface which is concave over the majority or substantially all of the radial extent of the support component.

Preferably the support assembly substantially covers an end of the radially expanding member. The support assembly may provide an extrusion barrier for the swellable elastomeric material.

The support assembly may be configured to be deployed to its second expanded condition by pivoting or otherwise deforming a main support component, which may be a main support ring. The support assembly may comprise an inner portion, positioned adjacent a body of the apparatus (which may be a tubular such as a base pipe, or may be a cylindrical mandrel) and a distal edge which moves outwardly with respect to the body of the apparatus. The support assembly preferably extends radially and longitudinally of the apparatus, and may therefore define an annular volume between the body of the apparatus and an inner surface of the support assembly. Advantageously, the volume of swellable elastomeric material adjacent a pivot or deformation point of the support assembly is increased compared with the prior art.

In a preferred embodiment of the invention, the apparatus comprises a first annular volume of swellable elastomeric material disposed between the support assembly and a body of the apparatus, which may be an elastomeric ring member formed from a swellable material. The elastomeric ring member may form a part of the radially expanding portion of the apparatus. The apparatus may comprise a second annular volume of swellable elastomeric material, which may be disposed on the body adjacent the first annular volume. The second annular volume of swellable elastomeric material may for example form a majority of the swellable mantle of a wellbore packer. Thus the radially expanding portion may be of compound construction, consisting of the first and second volumes of swellable elastomeric material in combination.

At an opposing end of the apparatus, a similar support assembly and/or volume of swellable material may be provided to complete the opposing end of the wellbore packer.

Using first and second annular volumes of swellable material may offer certain manufacturing and/or operational advantages. For example, the first and second annular volumes may be formed sequentially. In a preferred embodiment of the invention, the second annular volume is disposed on the body of the apparatus, and over at least a part of the first annular volume. The first annular volume may comprise a ring member, with a part sloping surface portion. Preferably the sloping surface portion is concave.

The interface between the first and second volumes of swellable elastomeric material may be configured to provide one or more exhaust paths for gases, which may otherwise become trapped under layers of rubber used to form the first and/or annular volumes. In particular, air may become trapped during the location of several layers of elastomer material during manufacturing process. Other gases, formed as by-products of the manufacturing process, may also become trapped.

An additional advantage of the compound structure comprising two volumes of swellable material is that different materials with different chemical or mechanical properties may be used to form the compound radially expanded portions. For example, the materials of the first and second annular volumes may be selected to differ in one or more of the following characteristics: fluid penetration, fluid absorption, swelling co-efficient, swelling coefficient, swelling rate, elongation coefficient, hardness, resilience, elasticity, tensile strength, shear strength, elastic modulus, and density. In one embodiment, the first volume is an elastomeric material selected to be relatively hard and relatively highly cross-linked, compared to the elastomer of the swellable mantle. This may reduce the tendency of the ring member to extrude before and after swelling.

The downhole apparatus or radially expanding portion may comprise one or more inlays of material selected to differ from a surrounding swellable elastomeric material in one or more of the following characteristics: fluid penetration, fluid absorption, swelling co-efficient, swelling coefficient, swelling rate, cross-linking, elongation coefficient, hardness, resilience, elasticity, tensile strength, shear strength, elastic modulus, or density. The downhole apparatus may comprise one or more inlays of non-swellable material, which may be located adjacent a part of a main support component of the support assembly. The one or more inlays may comprise an elastomeric material. One or more inlays may be configured to resist extrusion of a volume of swellable elastomeric material over a part of the support main support component, and/or may comprise an annular ring.

At least one anti-extrusion layer may be disposed between the swellable material and a main support component. The apparatus may comprise a containment layer disposed between the swellable material and the at least one anti-extrusion layer, which may be secured to a main support component of the support assembly. The containment layer may at least partially surround a neck of the main support component.

The support assembly may be configured to direct a force from the swellable material to boost or energize a seal created between the radially expanding portion and a surrounding surface in use.

It will be appreciated that embodiments of the second aspect of the invention may comprise preferred and/or optional features defined above with respect to the incorporation of the assembly within a downhole apparatus.

According to a third aspect of the invention there is provided a downhole apparatus having a radially expanding portion comprising a swellable elastomeric material selected to increase in volume on exposure to at least one predetermined fluid and a support assembly, wherein the support assembly comprises a main support component operable to be deployed from a first retracted position to a second expanded condition in which it at least partially covers an end of the radial expanding portion; and further comprises an energizing member disposed between the radially expanding portion and the main support component.

In this context "disposed between" means that the radially expanding portion and the main support component are positioned on either side of the energizing member, but does not necessarily mean "adjacent to" or "in abutment with," unless the context requires otherwise. In embodiments of the invention, there may be additional components located between the radially expanding portion and the energizing member, and/or the main support component and the energizing member.

Use of an energizing member serves to improve the deployment of the support device and/or the expansion of the radially expanding portion. Preferably, the energizing member directs a compression load to the radially expanding member, which may then be distributed as a radial expansion force. The energizing member may therefore direct compressive axial forces from the support member and transfer them to the radial expanding portion. The radial expanding portion may in turn act on the main support component to further deploy it to an expanded condition.

Preferably, the energizing member comprises an abutment surface, which may face the radially expanding portion. At least a portion of the abutment surface abuts a face or nose of the radial expanding portion. The abutment surface may be oriented in a plane perpendicular to the axis of the downhole apparatus, or may be inclined to such a plane in other embodiments. Preferably the energizing member is a ring, which may function as a piston in use.

Preferably, the energizing member is operable to direct an axial force, such as a force due to a pressure differential and/or weight on the base pipe, to the energizing member to energize a seal.

Preferably the energizing member is an energizing ring moveable on a body of the apparatus.

The support assembly, preferably a main support component thereof, may comprise a pivot which permits movement of the support assembly with respect to a body of the apparatus. The pivot may be radially displaced from the body of the apparatus, to create a lever effect in the support assembly. Movement of a part of the support assembly which is radially outward of the pivot may therefore generate a compressive force on the energizing member.

Embodiments of the third aspect of the invention may comprise preferred and/or optional features of the first or second aspect of the invention or vice versa.

According to a fourth aspect of the invention, there is provided a method of forming a seal in a wellbore, the method comprising the steps of: providing a downhole apparatus in a wellbore, the apparatus having a radially expanding portion comprising a swellable elastomeric material selected to increase in volume on exposure to at least one predetermined fluid; exposing the downhole apparatus to at least one predetermined fluid to swell the swellable elastomeric material and create a seal in the wellbore; deploying a support assembly to an expanded position in which it at least partially covers an end of the radially expanding portion; partially energizing the seal by directing a force from the support assembly to the radially expanding portion via an energizing member.

The method preferably involves deploying the support assembly by swelling of the swellable elastomeric material.

Preferably the force from the support assembly to the radially expanding portion is a compressive force. The compressive force may result, at least in part, from the deployment of the support assembly. In a preferred embodiment, the support assembly pivots or otherwise deforms by swelling of the swellable elastomeric material, and an inner part of the support assembly directs a compressive axial force through the energizing member. The energizing member preferably imparts a force on the swellable elastomeric material via an abutment surface. The swellable elastomeric material may direct the force from the support assembly radially outward, to enhance the seal with a surface surrounding the apparatus. In a preferred embodiment, the force is directed to further deploy the support assembly to an expanded position.

Embodiments of the fourth aspect of the invention may comprise preferred and/or optional features of any of the first to third aspects of the invention or vice versa.

According to a fifth aspect of the invention there is provided a downhole apparatus comprising a swellable elastomeric material selected to increase in volume on exposure to at least one predetermined fluid, the apparatus comprising a body, a ring member located on the body, and a volume of swellable elastomeric material disposed over the body proximal to at least a part of the ring member; wherein a gas exhaust path is provided between the ring member and the volume of swellable elastomeric material.

Preferably the volume of swellable elastomeric material is formed from multiple layers, which may be wrapped around the body. The multiple layers may be layers of uncured elastomer material. However, in alternative embodiments, the layers may be of partially, substantially, or fully cured elastomeric materials.

By providing an exhaust path, gases, including air or gases formed as by-products from the manufacturing process, are able to pass out of the volume and out to the surface. These gases may otherwise become trapped between layers of the swellable material leaving cavities in the formed body. Such cavities reduce the integral strength of the swellable body and/or create a potential failure mode. Gas pockets also affect the passage of fluids through the swellable body and therefore affect the swelling characteristics of the tool.

Preferably the apparatus comprises an outer layer of swellable material disposed over the gas exhaust path.

Embodiments of the fifth aspect of the invention may comprise preferred and/or optional features of any of the first to fourth aspects of the invention or vice versa.

The ring member may comprise a swellable elastic material, and may therefore form part of a compound radially expanding member. The swellable elastomer material of the ring member may be selected to have identical, or substantially the same, chemical and mechanical properties as the swellable elastomeric material selected for the volume. Alternatively, the material of the ring member may be selected to differ in one or more of the following characteristics: fluid penetration, fluid absorption, swelling coefficient, swelling co-efficient, swelling rate, elongation coefficient, hardness, resilience, elasticity, tensile strength, shear strength, elastic modulus, and density. In one embodiment, the elastomer of the ring member is selected to be relatively hard and relatively highly cross-linked, compared to the elastomer of the swellable mantle. This may reduce the tendency of the ring member to extrude before and after swelling.

In alternative embodiments of this aspect of the invention, the ring member is formed from, or partially formed from, a non-swellable material such as an elastomer, plastic, metal, ceramic, or composite material.

According to a sixth aspect of the invention there is provided a method of forming a downhole apparatus comprising a swellable elastomeric material selected to increase in volume on exposure to at least one predetermined fluid, the method comprising:

providing a ring member located on a body; forming a volume of swellable elastomeric material adjacent at least a part of the ring member; providing an exhaust path between the ring member and the volume of swellable elastomeric material for gases during the formation of the volume of swellable elastomeric material.

The method may comprise the additional step of forming multiple layers of a swellable elastomeric material to provide a swellable mantle.

The volume of swellable elastomeric material may be formed over at least a part of the ring member. The ring member may have a sloping surface portion. Successive layers of the swellable elastomeric material may be formed over successively greater parts of the ring member.

The method may include the subsequent step of curing (or re-curing) the multiple layers on the body, while maintaining the exhaust path.

The method may comprise a subsequent step of forming an outer layer of swellable elastomeric material over the exhaust path.

Embodiments of the sixth aspect of the invention may comprise preferred and/or optional features of any of the first to fifth aspects of the invention or vice versa.

According to a seventh aspect of the invention, there is provided a wellbore packer comprising the apparatus of any of the first, third or fifth aspects of the invention.

DETAILED DESCRIPTION

Figure 1:
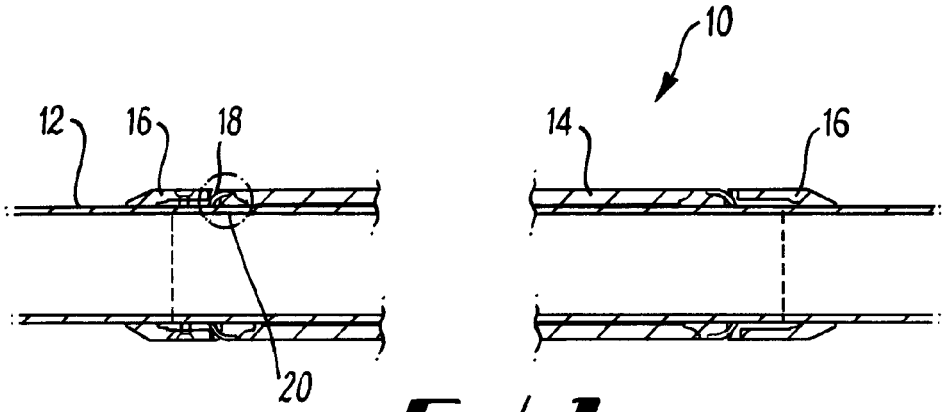
FIG. 1 is a longitudinal section through a wellbore packer incorporating a support assembly in accordance with an embodiment of the invention.

Referring firstly to FIG. 1, there is shown in longitudinal section a downhole apparatus in the form of a wellbore packer, generally depicted at 10. The wellbore packer 10 is formed on a base pipe 12, and comprises a mantle 14 and pair of end rings 16. A support assembly 18 is provided between the mantle 14 and each of the end rings 16 at opposing ends of the packer 10. The end rings 16 are secured to the base pipe 12, in this case by screws which extend radially through the end rings 16 and into abutment with the base pipe body 12.

The mantle 14 is formed from a swellable elastomeric material selected to increase in volume on exposure to a predetermined triggering fluid. Such materials are known in the art, for example from GB 2411918 and WO 2005/012686. In this embodiment, the swellable elastomeric material is an ethylene propylene diene monomer (EPDM) rubber selected to swell in hydrocarbon fluids, but alternative embodiments may comprise materials which swell in aqueous fluids, or which swell in both hydrocarbon and aqueous fluids. In FIG. 1, the apparatus is shown in a run-in configuration. The mantle 14 is in an unswollen condition, and its outer diameter (OD) is approximately flush with the OD of the end rings 16.

Figure 2:
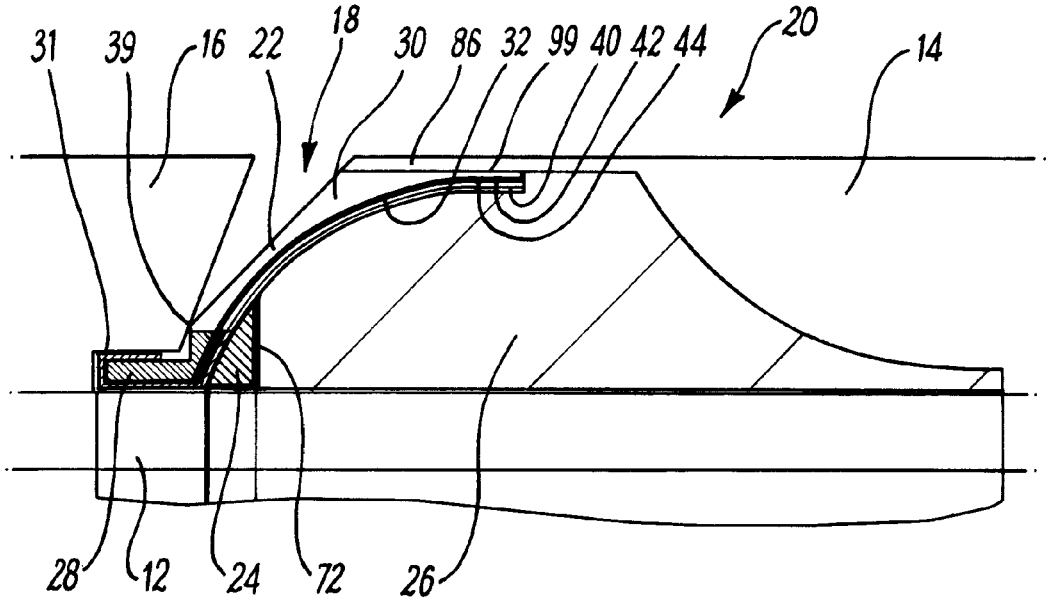
FIG. 2 is a longitudinal section of a detail of FIG. 1.
Figure 3:
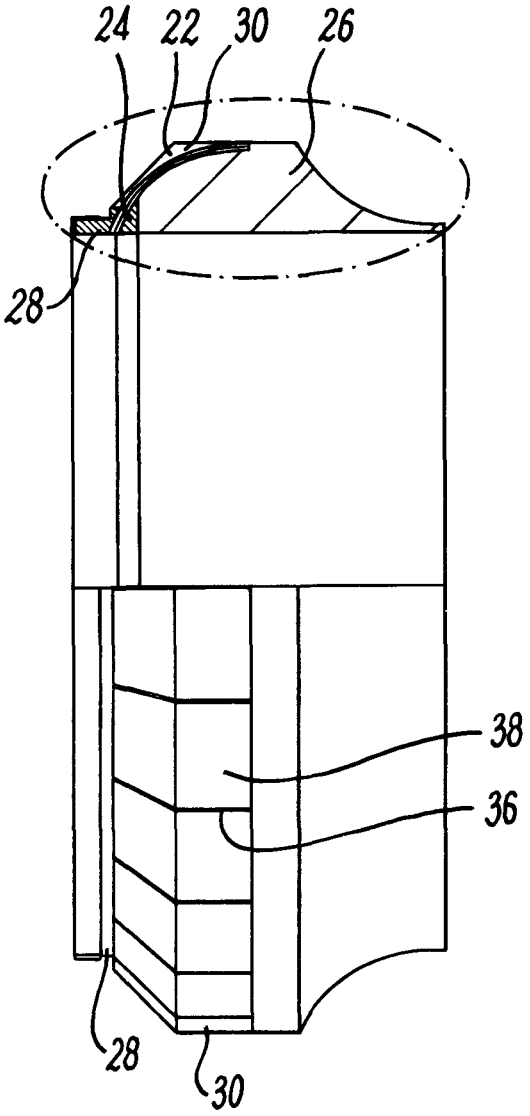
FIG. 3 is a longitudinal section and part side view part of a support assembly according to the embodiment of FIG. 1.

FIG. 2 is an enlarged view of a portion 20 of the wellbore packer 10. The drawing shows a longitudinal section of a part of the support assembly 18, an end ring 16, and the mantle 14. The construction of the apparatus 10 and the support assembly 18 is described herein with reference to FIGS. 3 to 11, which show parts of the apparatus in more detail. The support assembly 18 is shown before location on a base pipe 12 in FIG. 3. The upper half of FIG. 3 shows the assembly in section, and the lower half shows the assembly from an external side view.

The support assembly 18 comprises a main support ring 22, an energizing ring 24, and an elastomeric ring member 26, each defining throughbores sized to accommodate the base pipe 12. The main support ring 22 (shown most clearly in FIGS. 4A and 4B) is formed from a metal such as steel, and comprises a neck portion 28 and a flared portion 30. The neck portion 28 is received in a corresponding recess 31 in the end ring 19, and abuts the end wall of the recess. The flared portion 30 extends radially and longitudinally on the base pipe 12 to define an internal volume (when assembled) which accommodates a part of the elastomeric ring member 26. The main support ring 22 comprises a concave inner surface 32 which defines a cup, and the outer surface 34 is angled to define a conical part 34*a* and a cylindrical part 34*b*.

The main support ring 22 is provided with circumferentially spaced slots 36 which extend from an outer edge 35 (distal the base pipe), through the flared portion 30 to a predetermined depth, to define leaves 38 in the flared portion 30. The slots 36 facilitate deployment of the support assembly 18, allowing opening of the slots 36 by pivoting or deformation of the leaves 38. The slots 36 may for example be formed by water jet cutting or wire cutting.

The main support ring 22 also defines a pivot formation 39, which is in the form of a circular edge that abuts the end ring 16. The operation of the pivot 39 will be described below.

Figure 5B:
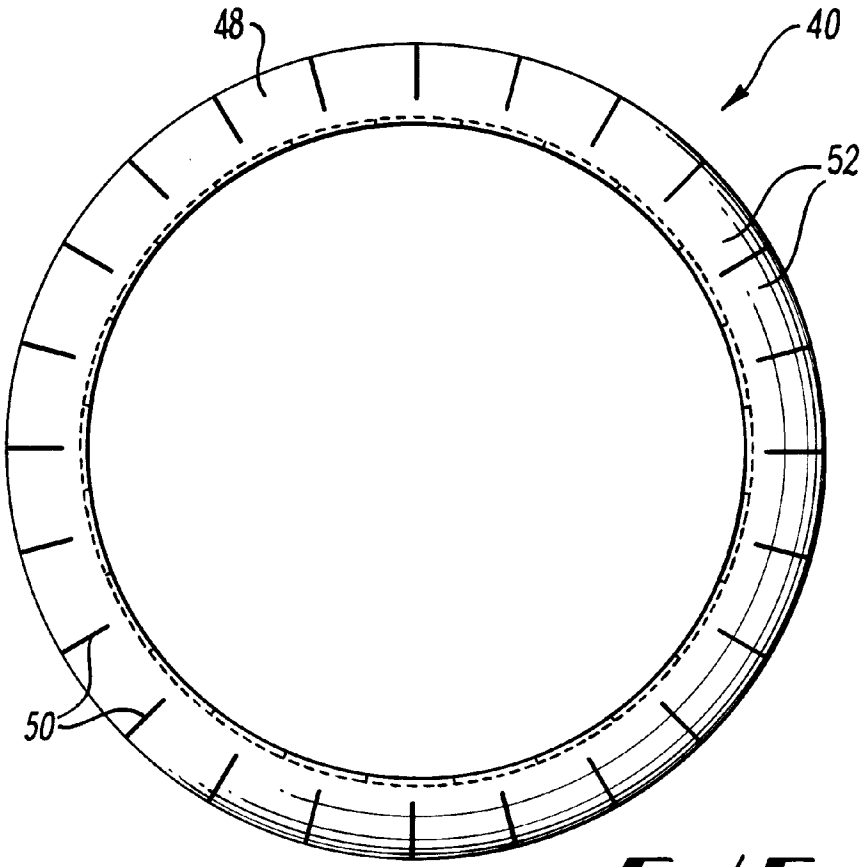
FIG. 5B is an end view of the containing layer of FIG. 5A.
Figure 5A:
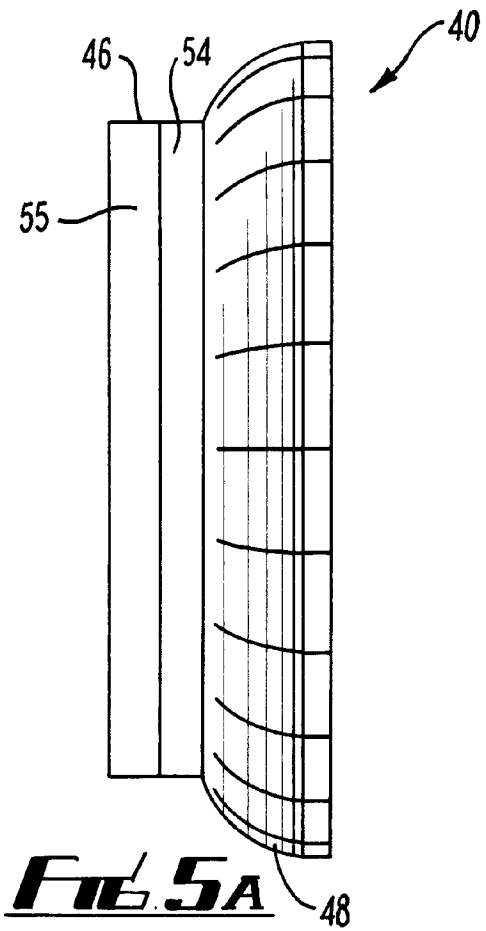
FIG. 5A is a side view of a containing layer used with the embodiment of FIG. 3.

The support assembly 18 comprises a containment layer 40, a first intermediate layer 42, and a second intermediate layer 44. The containment layer 40, shown in more detail in FIGS. 5A and 5B, is formed from a layer of C101 copper foil in a press-forming process. The layer 40 has an extended neck portion 46 and a flared portion 48 provided with a cup-like shape corresponding to the concave shape of inner surface 32 of the main support ring 22. Slots 50 are circumferentially spaced in the flared portion 48 to define leaves 52. The spacing of the slots 50 is selected to correspond to the spacing of the slots 36, although when the support assembly 18 is assembled, the slots are offset with respect to one another.

The extended neck portion 46 has an inner section 54 which is disposed between the main support ring 22 and the base pipe in use, and an outer section 55 which is forged to extend over and around the neck portion 28 of the main support ring 22, as is most clearly shown in FIG. 2. The containment layer 40 is therefore held in place in the assembly 18 by the main support ring 22.

Figure 6:
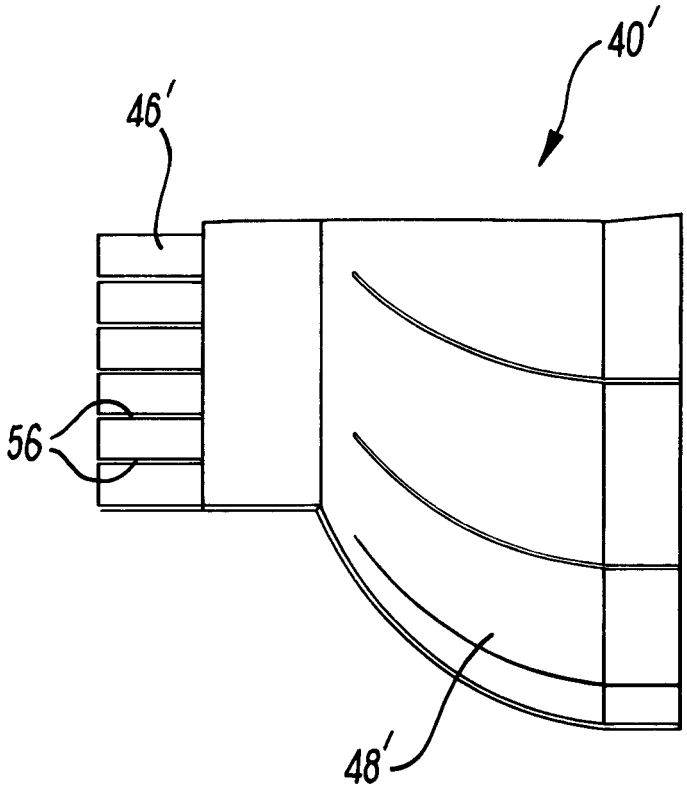
FIG. 6 is a detailed side view of a containing layer according to an alternative embodiment of the invention.

In an alternative embodiment of the invention, shown in FIG. 6, a containment layer 40' is used. The containment layer 40' is similar in shape and function to the containment layer 40, although its extended neck portion 46' differs in that it is provided with slots 56. The slots 56 facilitate flaring of the extended neck portion around the neck portion 28 of the main support ring 22.

Figure 7B:
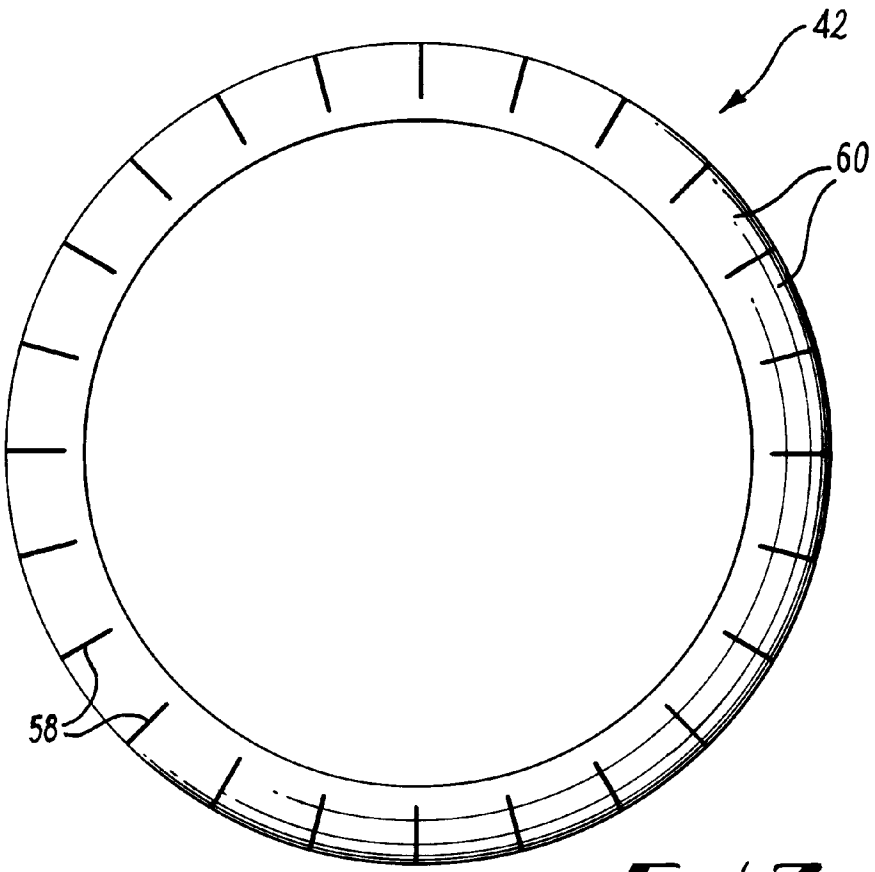
FIGS. 7A and 7B are respectively side and end views of a first intermediate layer of the embodiment of FIG. 3.
Figure 7A:
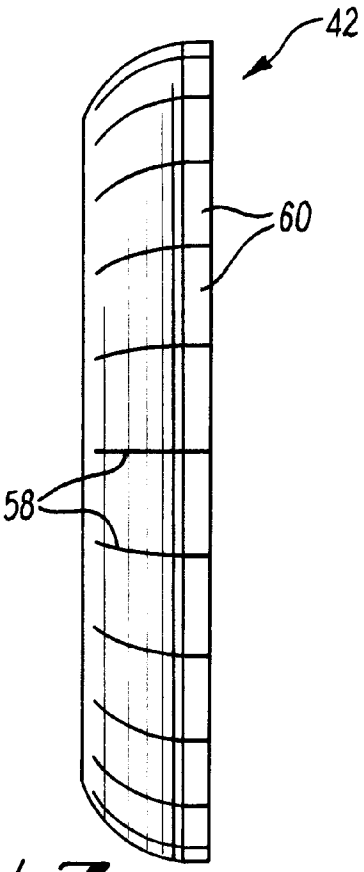

The first intermediate layer 42, shown most clearly in FIGS. 7A and 7B, is formed from a layer of C101 copper foil in a press-forming process, and is disposed between the containment layer 40 and the main support 22, adjacent the containment layer 40. The layer 42 is flared in a cup-like shape corresponding to the concave shape of inner surface 32 of the main support ring 22. Slots 58 define leaves 60, and again the spacing of the slots 58 is selected to correspond to the spacing of the slots 36. When the support assembly 18 is assembled, the slots 58 are offset with respect to the slots 36 and the slots 50. Thus the slots 36, 50 and 58 are phased such that they are out of alignment, and any path through the slots from an internal volume to the exterior of the assembly is highly convoluted.

Figure 8B:
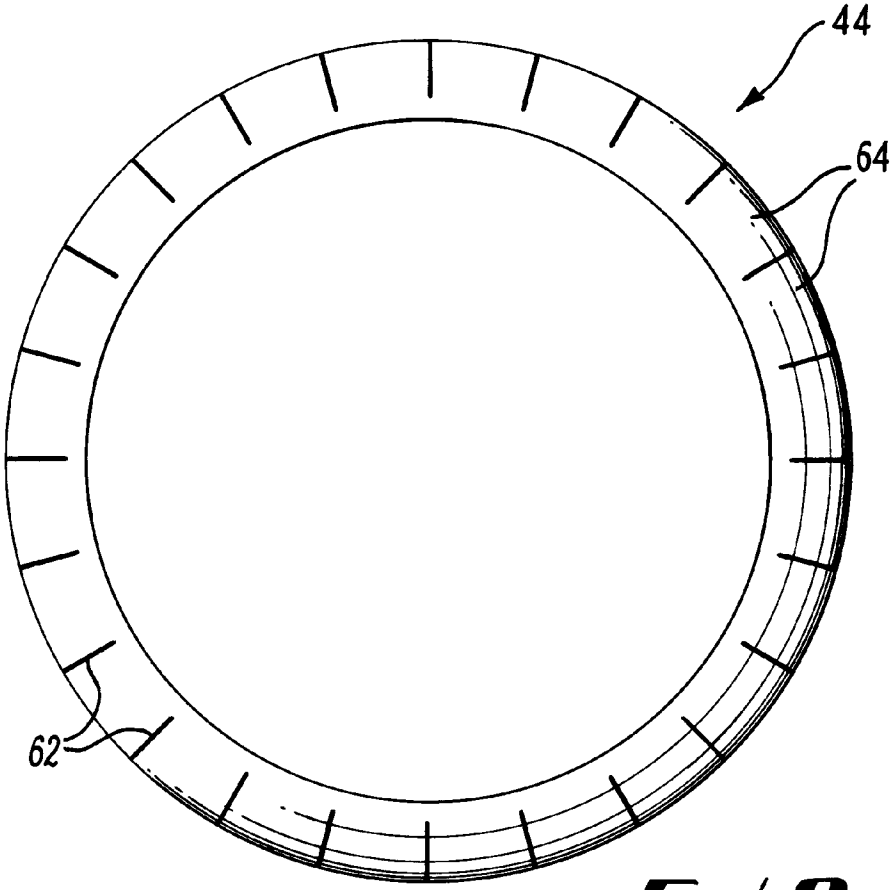
FIGS. 8A and 8B are respectively side and end views of a second intermediate layer of the embodiment of FIG. 3.
Figure 8A:
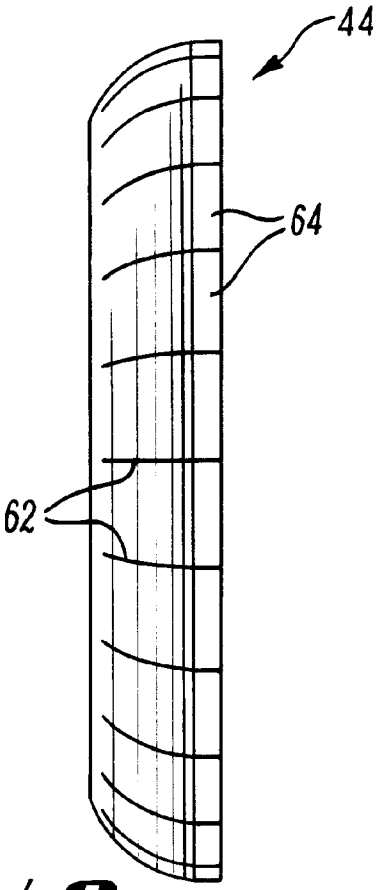

The second intermediate layer 44, shown most clearly in FIGS. 8A and 8B, is similar to layer 42 and will be understood from FIGS. 7A and 7B. However, the second intermediate layer differs in that it is formed from annealed stainless steel. The layer 44 is disposed between the layer 42 and the inner surface 32 of the main support ring 22. Slots 62, formed by water jet or wire cutting, define leaves 64, with the same angular spacing as the slots in the main support ring 22, and layers 40 and 42. The slots 62 are offset with the slots in the other layers to define a highly convoluted path from the internal volume defined by the assembly to a volume outside of the main support ring.

Figure 9:
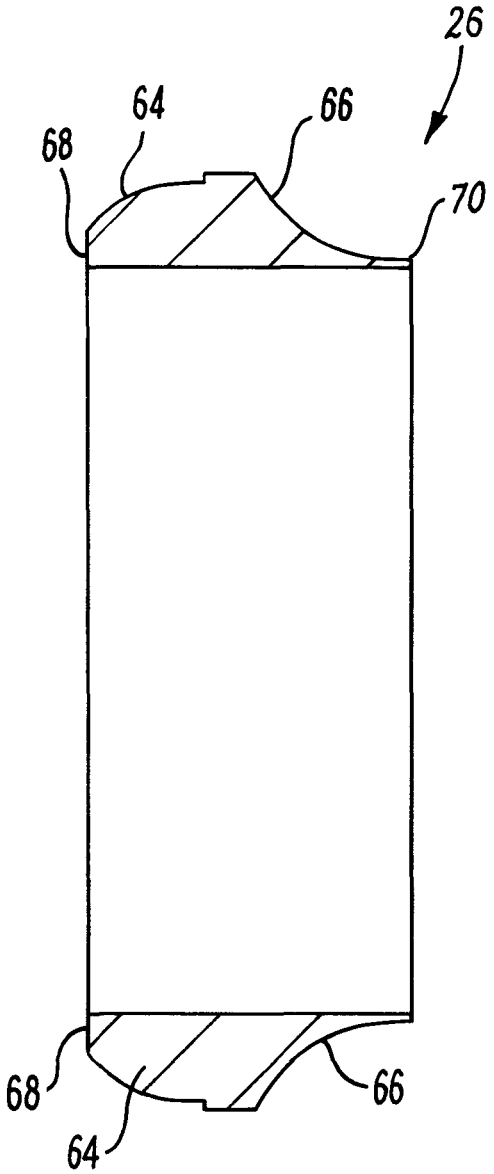
FIG. 9 is a longitudinal section of a ring member used in the embodiment of FIG. 3.
Figure 4B:
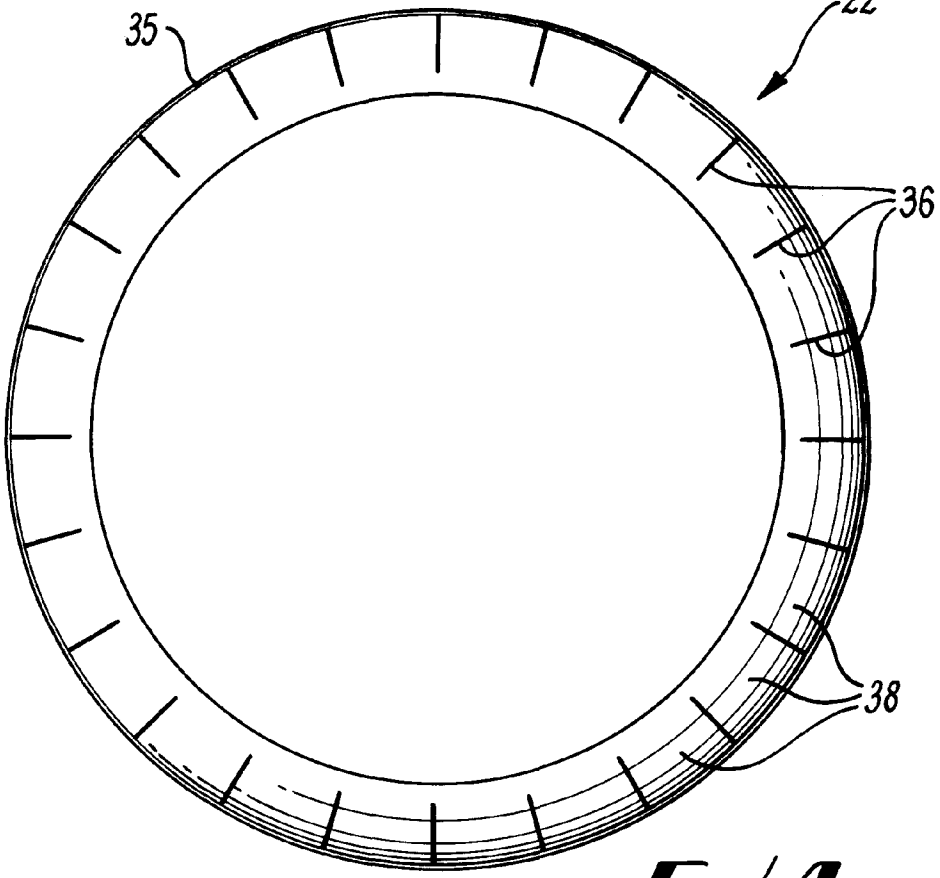
FIG. 4B is an end view showing an inside surface of the main support ring of the embodiment of FIG. 3.
Figure 4A:
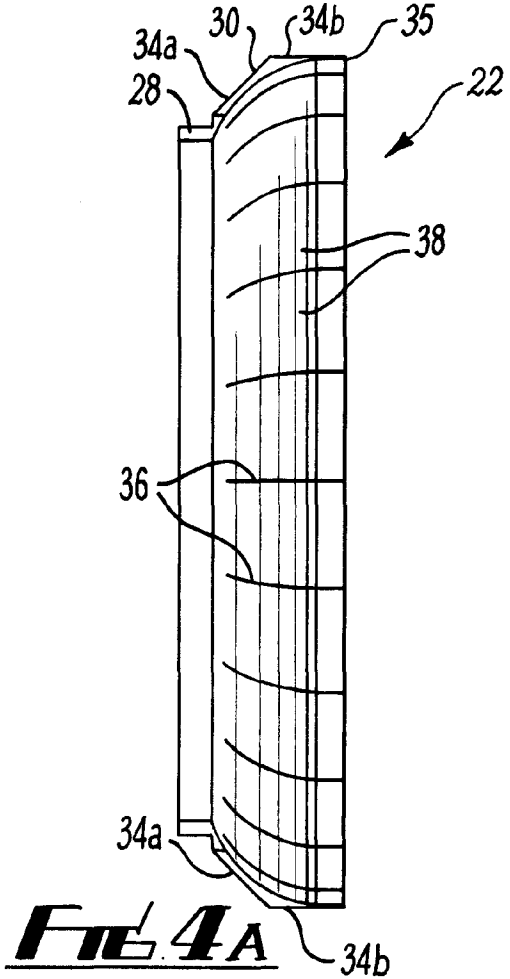
FIG. 4A is a part section through a main support ring of FIG. 3, showing some inside surface features.

The elastomeric ring member 26, shown in isolation in FIG. 9, is pre-moulded from a swellable elastomeric material, which in this case is the same as the swellable elastomeric material used to form mantle 14. The ring member 26 is disposed on and bonded to the base pipe 12 and has an outer end 64 which generally faces the support assembly 18, and an inner end 66 which generally faces the mantle 14. The outer end 64 has a convex shape which corresponds to the concave shape of the layers 40, 42, 44 and the surface 32, and a planar nose 68. The inner end 66 has a shape corresponding to the shape of the end of the mantle 14, and in this case is concave, sloping downwards from its OD to its innermost edge 70. The effects of the shape of the inner end 66 will be described in more detail below. The elastomeric ring member 26, together with the mantle 14, forms a radially expanding portion of the wellbore packer 10.

The energizing ring 24 is disposed on the base pipe 12 between the elastomeric ring member 26 and the main support ring 22. The energizing ring 24 is formed from a material which is harder than the elastomeric ring member 26 and the mantle 14, such as steel. In this embodiment, the energizing ring 24 is immediately adjacent the containment layer 40 and provides an abutment surface 72 which faces the nose 68 of the elastomeric ring member 26. In this embodiment the abutment surface 72 is planar, although variations such as concave, convex, or part-conical surfaces are within the scope of the invention. An opposing surface 74 of the ring 24 has a convex shape which corresponds to the concave shape of the layers 40, 42, 44 and the surface 32. The ring 24 has a leading edge 76 which extends into the space defined by the innermost part of layer 20 and the base pipe 12. The ring 24 is axially moveable on the base pipe 12.

Figure 10A:
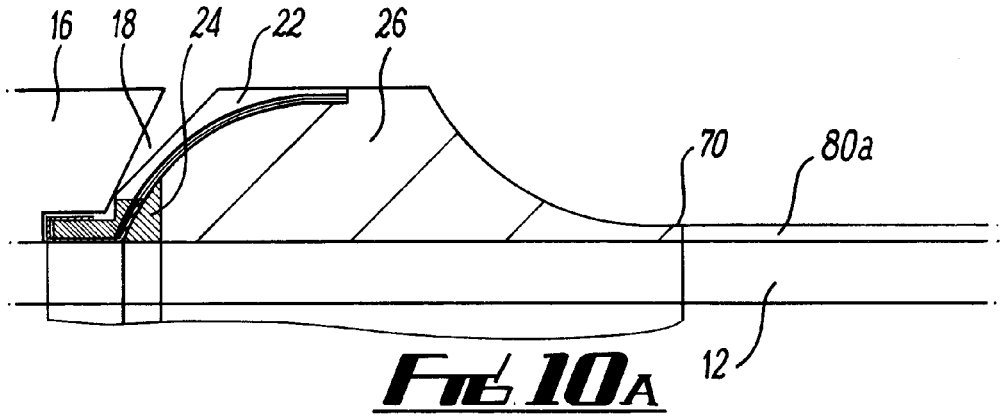
FIGS. 10A to 10C show schematically a manufacturing method according to an embodiment of the invention.
Figure 10B:
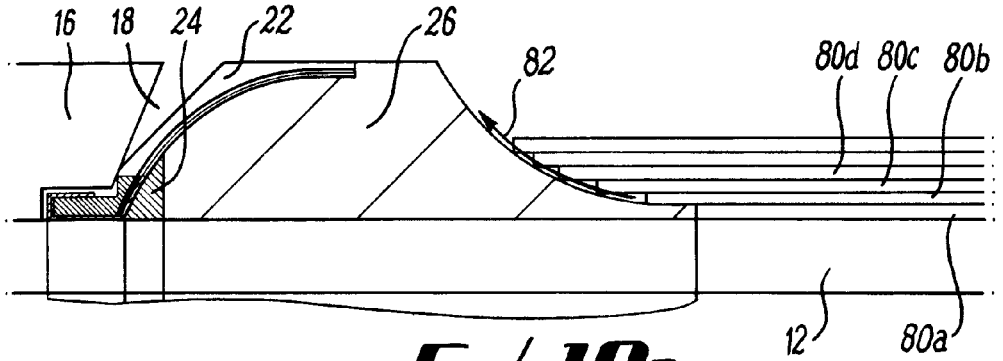
Figure 10C:
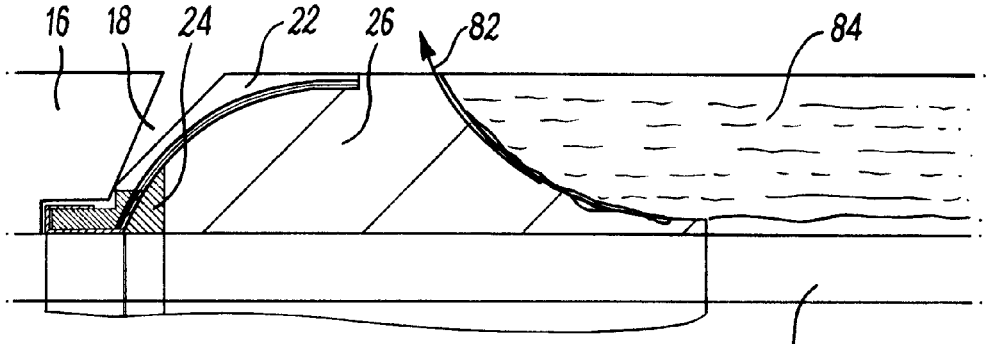

The wellbore packer 10 is manufactured as follows, with reference to FIGS. 10A to 10C of the drawings.

The support assembly 18, consisting of main support ring 22, energizing ring 24, elastomeric ring member 26 and layers 40, 42, and 44 is assembled on a base pipe 12. The elastomeric ring member 26 is bonded to the base pipe by a suitable adhesive. End ring 16 is secured to the base pipe by threaded screws (not shown) to axially restrain the support assembly 18. The innermost edge 70 of the elastomeric ring member has an OD equal to the thickness of one calendared sheet 80*a* of uncured elastomeric material, which is wrapped on and bonded to the base pipe 12. A second calendared sheet 80*b*, slightly wider than the first so that it extends over a greater axial length, is wrapped over the first layer and a part of the ring member 26. Third layer 80*c*, fourth layer 80*d* and successive layers are formed over the previous layers, each extending further over the inner section 66 of the ring member 26.

During lay-up of the elastomer layers on the base pipe 12 air, which may otherwise be trapped between the layers, is able to pass through the gas exhaust path 82 provided between the ring member 26 and the edges of the layers of elastomer 80. Layers are successively built up to form the mantle 84, which is then cured. A final layer 86 of elastomer is provided over the mantle and the cylindrical part of the main support ring 22, as shown in FIG. 2.

The inventors have appreciated that an appropriate shape of ring member allows the layers to be sequentially laid up, with each extending over a larger part of the ring member. This facilitates the exhaust of air and gas from between the layers to outside of the packer. Providing a concave surface on the facing section of the ring member is particularly advantageous, although a part-conical surface may also be used in other embodiments. In further variations, the layers of elastomer may have chamfered or curved edges to conform more closely to the profile of the ring member.

Use of the wellbore packer 10 will now be described with reference to FIGS. 2 and 11 of the drawings. FIG. 2 shows the packer in an unswollen condition before exposure to a triggering fluid. The support assembly 18 is in a retracted position, with the OD of the tool suitable for run-in to a wellbore location. The outer layer 86 of swellable material provides a lower friction coating for the support assembly 18 and protects it from snagging on obstructions in the wellbore during run-in, and from high velocity and potentially viscous fluids that may be pumped past the packer.

Figure 11:
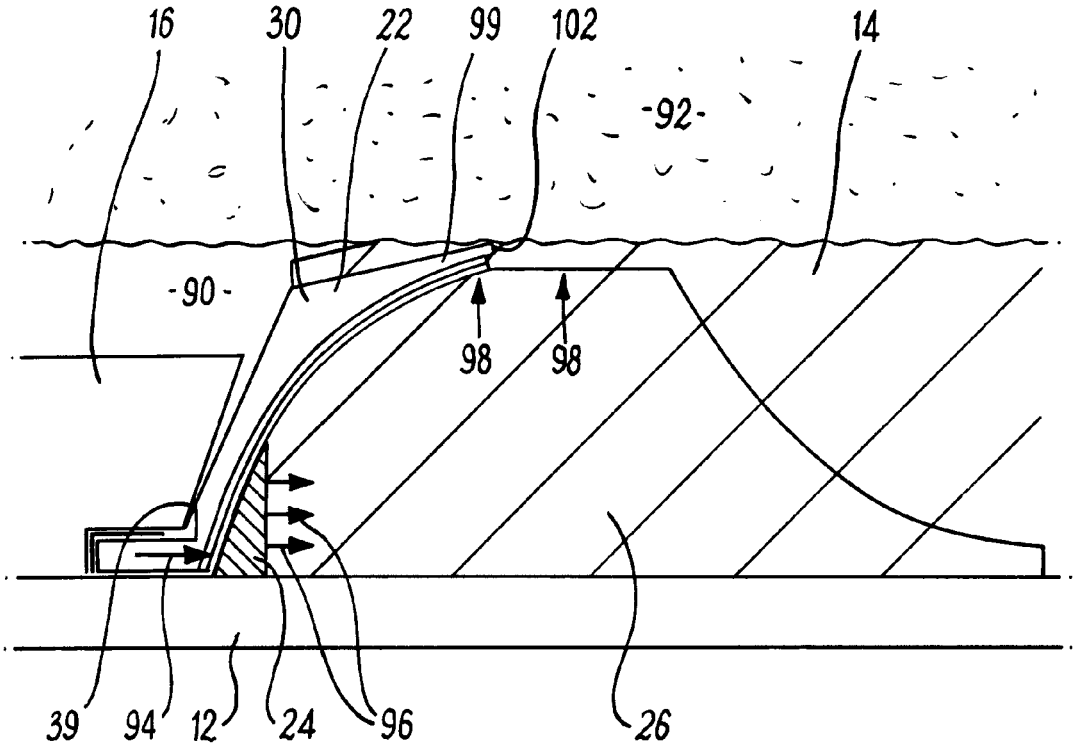
FIG. 11 schematically shows the wellbore packer and support assembly in an expanded condition in a wellbore.

FIG. 11 shows the wellbore packer 10 in a downhole location in a wellbore 90 in a formation 92. In this embodiment the packer is shown in an openhole bore, but use in cased hole operations is within the scope of the invention. In the wellbore 90 the packer is exposed to a triggering fluid, which may be a fluid naturally present in the well, or may be a fluid injected and/or circulated in the well. The fluid diffuses into the mantle 14 and causes an increase in volume. The elastomeric ring member 26, also formed from a swellable material, increases in volume and directs an outward radial force against the flared portion 30 of the main support ring 22, above the energizing ring 24 and the pivot 39 via the layers 40, 42, and 44. The force is sufficient to pivot and deform the main support ring 22 above the pivot 39, opening the slots 36 to deploy and expand the support assembly. Similarly the slots in the layers 40, 42 and 44 open to allow the leaves to be deployed to accommodate expansion of the ring member 26. Together the layers 40, 42, 44 and the main support ring 22 cover the end of the radially expanding portion formed by the ring member 26 and the mantle 14. The packer and the support assembly swell into contact with the surrounding surface of the wellbore to create a seal.

By providing a concave inner surface to the support assembly, a larger volume of swellable material can be accommodated beneath the support assembly per unit axial length of the support assembly. This results in an increased swell volume and more effective deployment. In addition, the axial length of the support assembly can be reduced compared with support assemblies described in the prior art. The parabolic bowl shape of the support assembly also provides an efficient transfer of radial and longitudinal swelling forces to the support assembly to enhance its deployment.

The support assembly 18 functions to mitigate the effects of forces on the swellable material which may otherwise adversely affect the seal. The support assembly 18 is operable to expand to the full extent of the wellbore cross section, and contains and supports the expanded packer over the whole wellbore. The support assembly 18 provides an extrusion barrier, mitigating or eliminating extrusion of the swellable material which may otherwise be caused by shear forces in the swellable material due to pressure differential across the seal and/or axial forces on the base pipe. The slots of the respective layers are offset with respect to one another to provide a convoluted path which reduces the likelihood of extrusion.

Forces on the support assembly due to continued expansion or axial forces on the base pipe tend to further deploy the support assembly. The pivoting movement of the main support ring 22 about pivot 39 leverages a compressive force through the layers 40, 42, 44 to the energizing ring 24, as depicted by arrow 94. The energizing ring 24 is axially moveable on the base pipe, and its movement transfers the compressive force to the nose 78 of the ring member 26, as depicted by arrows 96. The compressive force is distributed through the ring member 26 and has a radial component 98 which boosts the seal. Thus axial forces due to pressure differentials and/or weight on base pipe tend to be redirected through the support assembly and the energizing ring, back to the sealing components to energize and boost the seal. The concave shape and energizing member is particularly effective at capturing longitudinal forces in the elastomer and utilising them to enhance the seal.

An additional feature of the assembly is that the flared portion 30 may be deformed against the surrounding surface of the openhole. By continued deployment, the relatively thin outer edge 99 of the flared portion 30 is deformed to provide a bearing surface which conforms to the openhole surface. This provides effective containment of the volume of swellable material.

Figure 12:
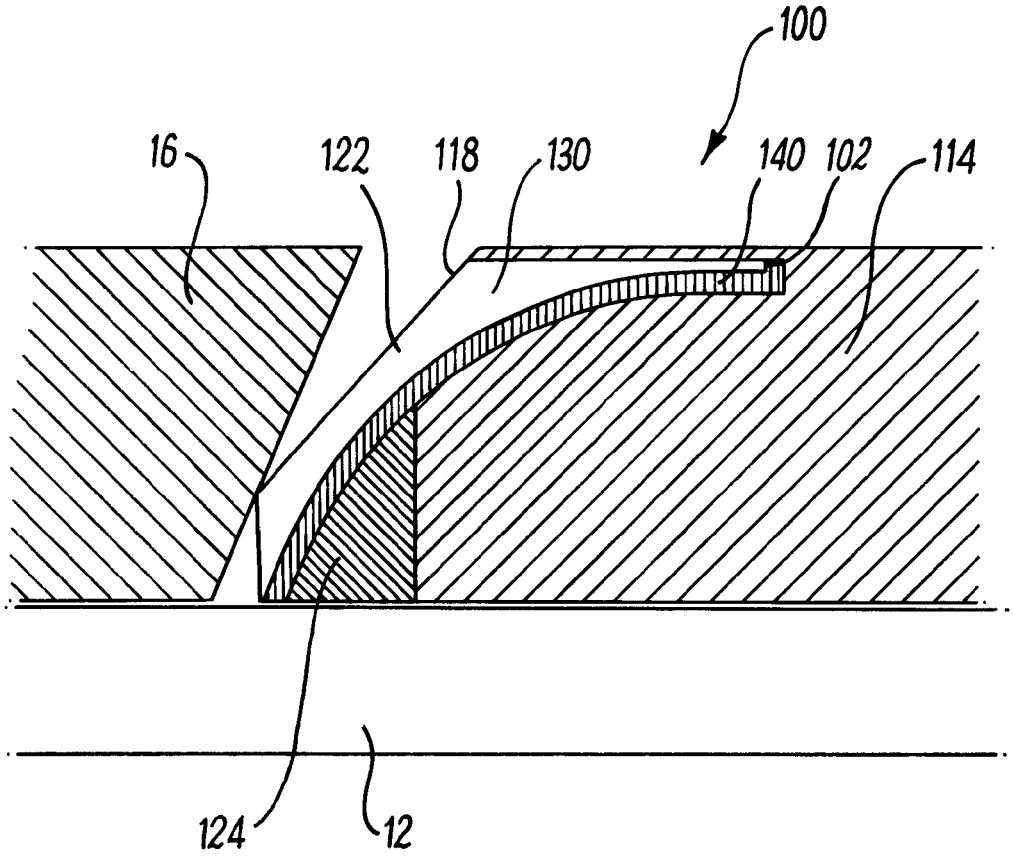
FIG. 12 is a sectional view through a detail of a support assembly in accordance with an alternative embodiment of the invention.

A wellbore packer 100 having a support assembly 118 according to an alternative embodiment of the invention is shown in FIG. 12. The support assembly 118 is similar to support assembly 18, with like parts depicted by like reference numerals incremented by 100, and its operation will be understood from the foregoing description. The support assembly 118 is located on a base pipe 12 adjacent an end ring 16. However, the configuration differs in that the support assembly does not include an elastomeric ring member. Instead, the mantle 114 itself is shaped to fit within the volume defined by the support assembly 118. This embodiment illustrates that the radially expanding portion need not be a compound portion formed from a mantle and an elastomeric ring member. Expansion of the mantle 114 causes deployment of the support assembly 118, and the energizing ring 124 boosts the seal. Intermediate layers are disposed between the main support ring 122 and a containment layer, but are not shown in this drawing. A further difference of this embodiment is that the containment layer 140 extends beyond the edge 102 of the flared portion 130 of the main support member 122. The containment layer 140 is longer to ensure that as the main support ring flares outwards, the containment layers form a feathered edge at point 102, creating a softer interface between the edge 102 of the support member 122 and the adjacent swellable material 114.

Figure 13:
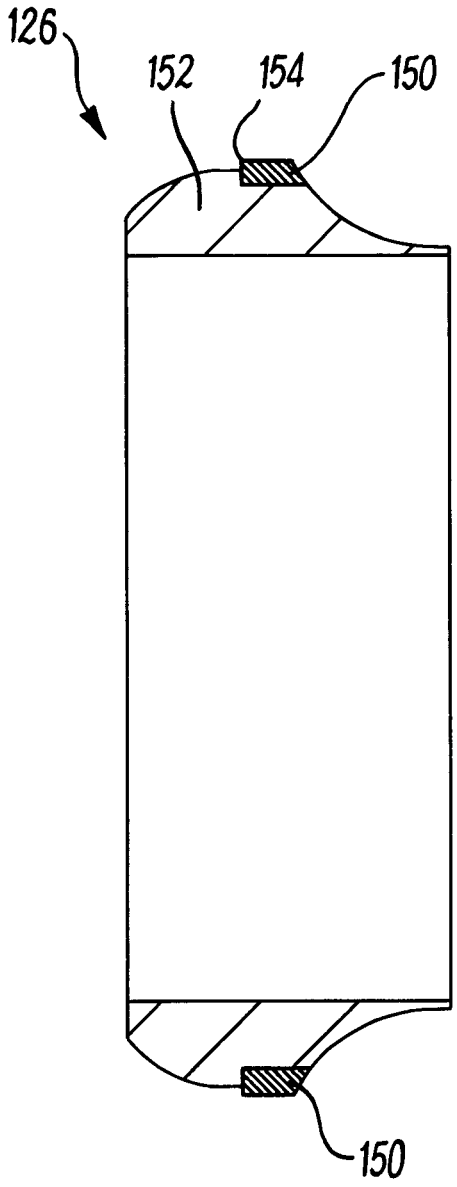
FIG. 13 is a sectional view through a ring member in accordance with a further alternative embodiment of the invention.

FIG. 13 shows an alternative ring member 126 that may be used with embodiments of the invention. The ring member 126 is similar in form and function to the ring member 26 described with reference to FIG. 9. However, ring member 126 differs in that is provided with an inlay 150 of a non-swellable elastomeric material. The inlay 150 is in the form of an annular ring, located around the outer surface of the main body 152 of swellable elastomeric material in the ring. The inlay is disposed at a lip 154 which is positioned adjacent an edge 102 of the main support ring 22 or 122 and the layers of the assembly.

The inlay 150 is formed from a non-swellable elastomeric material, and therefore does not swell on exposure to a triggering fluid. However, the elastomeric properties allow the inlay 150 to be stretched to accommodate expansion of the swellable elastomeric material forming the main body 152 of the ring.

Because the inlay 150 is formed from a non swellable elastomeric material, it does not lose mechanical properties such as hardness and shear, and therefore has a reduced tendency to extrude over the edge 102 of the support ring. This improves the anti-extrusion properties of the assembly.

Figure 14:
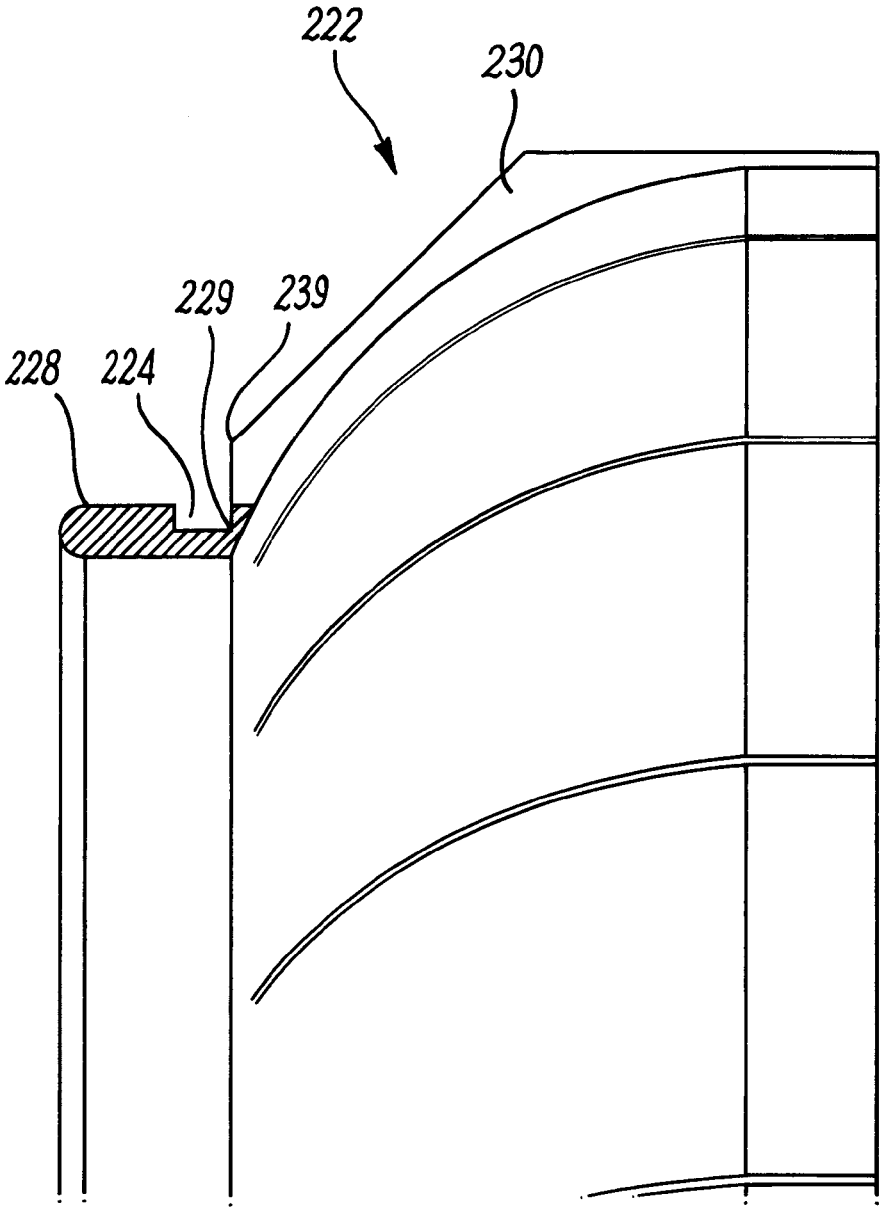
FIG. 14 is a sectional view through a detail of a support assembly in accordance with a further alternative embodiment of the invention.

FIG. 14 shows a main support ring 222 according to an alternative embodiment of the invention. The main support ring 222 is similar to support ring 22, and its operation will be understood from the foregoing description. Like parts are designated by like reference numerals, incremented by 200. Support ring 222 differs in that it is provided with a weakened formation 224, located between the neck 228 and the flared portion 230. In this embodiment, the weakened formation is located on the neck 228 at the junction 229 between the neck and the flared portion 230.

One function of the weakened formation 224 is to allow operation of the support assembly in a situation in which the swellable elastomeric material cannot be compressed by the energizing member (not shown). Forces on the flared portion 230 from the swellable elastomeric material will tend to cause the main support ring 222 to pivot around the pivot 239. If however the energizing member is immovable against the volume of elastomeric material, for example due to loading within the elastomeric material, the neck 228 of the main support ring 222 will not be able to travel on the base pipe, limiting the deployment of the support assembly. Stresses will build up in the main support ring 222, and may become large enough to shear the neck 228 from the flared portion 230 at the weakened formation 224. This allows the flared portion 230 to be further deployed without being restricted by the incompressibility of the elastomeric material. The embodiment therefore provides a frangible main support ring 222.

In addition, the weakened portion 224 provides an alternative pivot point for deployment of the main support ring due to axial and/or radial forces experienced from the swellable elastomer. This arrangement allows use of the ring with different end ring structures, which may not necessarily provide a suitable abutment for the pivot 39 as described with reference to FIG. 11.

Figure 15:
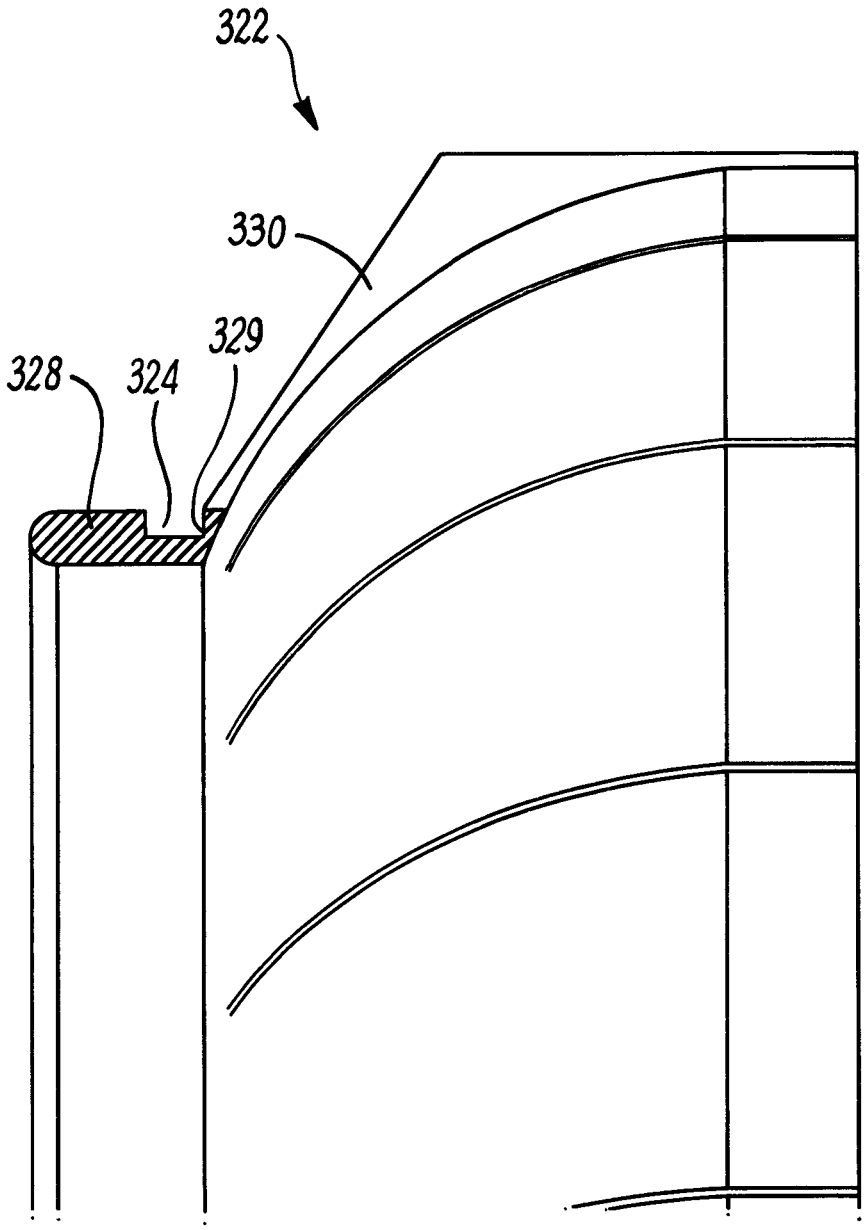
FIG. 15 is a sectional view through a detail of a support assembly in accordance with a further alternative embodiment of the invention.

FIG. 15 shows a further alternative main support ring 322, which is similar to the main support ring 222, having a neck 328 and a flared portion 330. As with the embodiment of FIG. 13, a weakened formation 324 is provided. The main support ring 322 differs in that pivot ring, equivalent to the pivot 39, is omitted. Thus there is no pivot which abuts a part of the end ring in this embodiment. Providing a weakened formation 324 at the interface 329 between the neck portion and the flared portion facilitates pivoting of the flared portion and therefore deployment of the support assembly of this embodiment.

Because the pivot is located at the base of the main support ring 322, the compressive force directed through the main support ring to the elastomeric material is negligible. Thus this embodiment provides no substantial energizing effect on the seal, and is most suited for use in an embodiment which omits an energizing member from the assembly.

The present invention provides in one of its aspects a support assembly for use with well packers or other expanding downhole apparatus. One of the advantages of the invention is the ability to provide a seal in the annulus of high pressure integrity per unit length of expanding member. This permits operation under high pressure or weight conditions, or alternatively allows a reduction in the length or number of packers used in a particular application having a required pressure rating.

The invention also allows an expanding apparatus to be used over a range of operating parameters. For example, by providing support to the expanding portion it may be acceptable to expand the apparatus to a greater degree. This facilitates use in a wide range of bore diameters, In one aspect, a concave shape of support assembly maximises the volume of elastomeric material beneath the support assembly in a manner that is efficient in terms of the length and radius of the assembly. The shape also efficiently transfers forces from the elastomeric material to deploy the support assembly and maintain the seal.

In another aspect, a means is provided for energizing the seal. A further aspect provides an exhaust gas path which allows an improved swellable elastomeric component to be formed.

Variations and modifications to the above described embodiments may be made within the scope of the invention herein intended. For example, although in the described embodiments described particular configurations of layers, it will be appreciated that other configurations, including the addition or omission of layers, are within the scope of the invention. In addition, it will be apparent that multiple elastomeric volumes or inlays may be used with the present invention. The multiple volumes may be selected to have different characteristics, such as hardness or swell rates, in order to affect the distribution of forces in the radial expanding portion.

The materials used to form the components of the support assembly may be varied according to the required application and performance. For example, the assembly may include components formed from materials selected from steels, plastics, epoxy resins, elastomers or natural rubbers of varying hardness, aluminium alloys, tin plate, coppers, brass, other metals, KEVLAR® or other composites, carbon fibre and others (KEVLAR® is a registered trademark of E. I. du Pont de Nemours and Company). Any of a number of suitable manufacturing techniques may be used, including press forming and machining.

Combinations of features other than those expressly claimed are within the scope of the invention, and it will be understood that features of certain embodiments may be incorporated in other specific embodiments of the invention.

What is claimed is:

1. A downhole apparatus comprising:

a body;

a radially expanding portion disposed on the body, comprising a swellable elastomeric material selected to increase in volume on exposure to at least one predetermined fluid; and a support assembly disposed on the body, comprising:

a main support component operable to be deployed from a first retracted position to a second expanded condition in which the main support component at least partially covers an end of the radially expanding portion; and an energizing member disposed between the radially expanding portion and the main support component, comprising:

an energizing ring axially moveable on the body of the apparatus; and wherein the support assembly pivots or otherwise deforms by swelling of the swellable elastomeric material.

2. The downhole apparatus of claim 1, wherein the apparatus is configured to swell in a wellbore on exposure to a well fluid.

3. The downhole apparatus of claim 1, wherein the main support component is operable to be deployed from the first retracted position to the second expanded condition by swelling of the swellable elastomeric material.

4. The downhole apparatus of claim 1, wherein the support assembly provides an extrusion barrier for the swellable elastomeric material.

5. The downhole apparatus of claim 1, wherein the energizing member transfers a load from the support assembly to compress the radially expanding portion.

6. The downhole apparatus of claim 1, wherein the energizing member comprises an abutment surface which faces the radially expanding portion.

7. The downhole apparatus of claim 6, wherein the abutment surface is oriented in a plane perpendicular to an axis of the downhole apparatus.

8. The downhole apparatus of claim 1, wherein the energizing member functions as a piston in use.

9. The downhole apparatus of claim 1, wherein the support assembly is operable to direct an axial force to the energizing member to energize a seal.

10. The downhole apparatus of claim 1, wherein the main support component comprises:

a neck disposed on the body of the apparatus;

a flared portion; and a weakened formation, disposed between the neck and the flared portion and joining the neck to the flared portion.

11. The downhole apparatus of claim 10, wherein the weakened formation creates a pivot between the neck and the flared portion.

12. The downhole apparatus of claim 10, wherein the weakened formation is configured to allow shearing of the neck from the flared portion.

13. The downhole apparatus of claim 1, wherein the support assembly is operable to be deployed to the second expanded condition of the support assembly by radial and longitudinal forces imparted by the swellable elastomeric material.

14. The downhole apparatus of claim 1, wherein the support assembly is configured to direct a force from the swellable material to boost or energize a seal created between the radially expanding portion and a surrounding surface in use.

15. The downhole apparatus of claim 1, wherein the radially expanding portion further comprises:

a first annular volume of swellable elastomeric material disposed adjacent the support assembly; and a second annular volume of swellable elastomeric material disposed over at least a part of the first annular volume.

16. The downhole apparatus of claim 1, wherein the support assembly comprises an inner surface arranged to face the radially expanding portion, and at least a part of the inner surface is concave.

17. The downhole apparatus as claimed in claim 16, wherein the inner surface comprises a parabolic shape.

18. The downhole apparatus of claim 1, wherein the energizing member further comprises an elastomeric ring member comprising a swellable elastomeric material selected to increase in volume upon exposure to both aqueous solutions and hydrocarbons, wherein swelling of the elastomeric ring member urges the main support component from the first retracted position to the second expanded condition.

19. A method of forming a seal in a wellbore, the method comprising:

providing a downhole apparatus in a wellbore, the apparatus having a radially expanding portion disposed on a body of the apparatus comprising a swellable elastomeric material selected to increase in volume on exposure to at least one predetermined fluid;

exposing the downhole apparatus to at least one predetermined fluid to swell the swellable elastomeric material and create a seal in the wellbore;

deploying a support assembly to an expanded position in which the support assembly at least partially covers an end of the radially expanding portion; and partially energizing the seal by directing a force from the support assembly to the radially expanding portion via an energizing ring axially moveable on the body of the apparatus; and wherein the support assembly pivots or otherwise deforms by swelling of the swellable elastomeric material.

20. The method of claim 19, comprising swelling the swellable elastomeric material in the wellbore by exposing the swellable elastomeric material to a well fluid.

21. The method of claim 19, comprising deploying the support assembly by swelling of the swellable elastomeric material.

22. The method of claim 19, wherein the support assembly provides an extrusion barrier for the swellable elastomeric material.

23. The method of claim 19, wherein the force from the support assembly to the radially expanding portion is a compressive force, which at least in part, results in deployment of the support assembly.

24. The method of claim 19, wherein an inner part of the support assembly directs a compressive axial force through the energizing member.

25. The method of claim 19, wherein the energizing ring imparts a force on the swellable elastomeric material via an abutment surface.

26. The method of claim 19, wherein the swellable elastomeric material directs the force from the support assembly radially outward, to enhance the seal with a surface surrounding the apparatus.

27. The method of claim 19, wherein the swellable elastomeric material directs the force to further deploy the support assembly to an expanded position.

28. The method of claim 19, wherein the method further comprises urging the support assembly to deploy to the expanded position by an elastomeric ring member disposed between the support assembly and the radially expanding portion, comprising a second swellable elastomeric material selected to increase in volume upon exposure to both aqueous solutions and hydrocarbons.

29. A downhole apparatus comprising:

a body;

a radially expanding portion disposed on the body, comprising a swellable elastomeric material selected to increase in volume in a wellbore on exposure to at least one predetermined well fluid; and a support assembly disposed on the body, comprising:

a main support component operable to be deployed from a first retracted position to a second expanded condition in which the main support component at least partially covers an end of the radially expanding portion; and an energizing member disposed between the radially expanding portion and the main support component, comprising:

an energizing ring axially moveable on the body of the apparatus; and wherein the support assembly pivots or otherwise deforms by swelling of the swellable elastomeric material.

30. The downhole apparatus of claim 29, wherein the energizing member further comprises an elastomeric ring member comprising a swellable elastomeric material selected to increase in volume upon exposure to both aqueous solutions and hydrocarbons, wherein swelling of the elastomeric ring member urges the main support component from the first retracted position to the second expanded condition.

31. A downhole apparatus comprising:

a body;

a radially expanding portion disposed on the body comprising a swellable elastomeric material selected to increase in volume on exposure to at least one predetermined fluid; and a support assembly disposed on the body, comprising:

a main support component operable to be deployed by swelling of the swellable elastomeric material from a first retracted position to a second expanded condition in which the main support component at least partially covers an end of the radially expanding portion; and an energizing member disposed between the radially expanding portion and the main support component, comprising:

an energizing ring axially moveable on the body of the apparatus; and wherein the support assembly pivots or otherwise deforms by swelling of the swellable elastomeric material.

32. The downhole apparatus of claim 31, wherein the energizing member further comprises an elastomeric ring member comprising a swellable elastomeric material selected to increase in volume upon exposure to both aqueous solutions and hydrocarbons, wherein swelling of the elastomeric ring member urges the main support component from the first retracted position to the second expanded condition.

33. A method of forming a seal in a wellbore, the method comprising:

providing a downhole apparatus in a wellbore, the apparatus having a radially expanding portion disposed on a body of the apparatus comprising a swellable elastomeric material selected to increase in volume on exposure to at least one predetermined well fluid;

exposing the downhole apparatus to at least one predetermined well fluid to swell the swellable elastomeric material and create a seal in the wellbore;

deploying a support assembly to an expanded position in which the support assembly at least partially covers an end of the radially expanding portion; and partially energizing the seal by directing a force from the support assembly to the radially expanding portion via an energizing ring axially moveable on the body of the apparatus; and wherein the support assembly pivots or otherwise deforms by swelling of the swellable elastomeric material.

34. The method of claim 33, wherein the method further comprises urging the support assembly to deploy to the expanded position by an elastomeric ring member disposed between the support assembly and the radially expanding portion, comprising a second swellable elastomeric material selected to increase in volume upon exposure to both aqueous solutions and hydrocarbons.

35. A method of forming a seal in a wellbore, the method comprising:

providing a downhole apparatus in a wellbore, the apparatus having a radially expanding portion disposed on the body of the apparatus comprising a swellable elastomeric material selected to increase in volume on exposure to at least one predetermined fluid;

exposing the downhole apparatus to at least one predetermined fluid to swell the swellable elastomeric material and create a seal in the wellbore;

deploying a support assembly, by swelling of the swellable elastomeric material, to an expanded position in which the main support assembly at least partially covers an end of the radially expanding portion; and partially energizing the seal by directing a force from the support assembly to the radially expanding portion via an energizing ring axially moveable on the body of the apparatus; and wherein the support assembly pivots or otherwise deforms by swelling of the swellable elastomeric material.

36. The method of claim 35, wherein the method further comprises urging the support assembly to deploy to the expanded position by an elastomeric ring member disposed between the support assembly and the radially expanding portion, comprising a second swellable elastomeric material selected to increase in volume upon exposure to both aqueous solutions and hydrocarbons.

* * * * *